United States Patent [19]

Van Marcke

[11] Patent Number: 4,597,404

[45] Date of Patent: Jul. 1, 1986

[54] PLUMBING FIXTURE

[75] Inventor: Karel C. Van Marcke, Kruishoutem, Belgium

[73] Assignee: International Sanitary Ware Manuf. Cy., Kruishoutem, Belgium

[21] Appl. No.: 773,204

[22] Filed: Sep. 6, 1985

[51] Int. Cl.[4] ..... F16K 3/36

[52] U.S. Cl. ..... 137/1; 137/15; 137/247.51; 137/269; D23/46; 4/DIG. 7; 4/206; 285/153

[58] Field of Search ..... 137/1, 15, 247.41, 247.45, 137/247.47, 247.49, 247.51, 247.11, 269, 561 A; 4/DIG. 7, 206, 211; 285/3, 4, 153, 154, 12; D23/40, 46

[56] References Cited

U.S. PATENT DOCUMENTS

| | | | |
|---|---|---|---|
| 309,260 | 12/1884 | Taylor | 137/269 |
| 483,961 | 10/1892 | Horgan | 137/247.11 |
| 598,992 | 2/1898 | Hosford | 137/247.51 |
| 776,299 | 11/1904 | Cornelius | 137/247.11 X |
| 904,082 | 11/1908 | Parker | 137/247.11 X |
| 985,969 | 3/1911 | Beckway | 4/211 |
| 1,796,685 | 3/1931 | Edelman | 137/247.41 X |
| 3,470,900 | 10/1969 | Rothauser | 137/247.51 |

FOREIGN PATENT DOCUMENTS

| | | | |
|---|---|---|---|
| 557033 | 5/1957 | Belgium | 137/247.41 |
| 451262 | 7/1936 | United Kingdom | 137/247.11 |

*Primary Examiner*—Harold W. Weakley

*Attorney, Agent, or Firm*—Cahill, Sutton & Thomas

[57] ABSTRACT

An integrated plumbing fixture for drains and having a P-trap includes a vent downstream of the P-trap and a plurality of horizontally and vertically oriented outlets upstream and downstream of the P-trap, one of which outlets may be selected to accommodate various on-site constraints and requirements.

15 Claims, 5 Drawing Figures

PLUMBING FIXTURE

The present invention relates to plumbing fixtures and, more particularly, to a plumbing fixture for use in conjunction with a drain.

Most drains in private dwellings or commercial establishments evacuate the fluid flowing therethrough into a conduit forming a part of a sewage system. Depending upon local ordinances and plumbing codes, a P-trap may be employed intermediate the drain and the sewage system to prevent back flow of unpleasant or dangerous gases. Furthermore, such P-traps tend to dissuade certain insects and other life forms from migrating from the sewage system into the container from which the drain depends. To aid in preventing a build-up of unpleasant or dangerous gases within the conduit connected to the sewage system, an upwardly extending vent downstream of the P-trap may be employed.

Certain on-site physical constraints may place restrictions on the flow direction downstream of the P-trap, which restrictions require addition of further fixtures and impose additional installation charges. Under certain conditions, a P-trap would not be employed in immediate conjunction with a drain; moreover, the on-site physical constraints may dictate the use of a vertically downwardly oriented or a horizontally oriented conduit downstream of the drain. A vent for venting of the fluid outflow from the drain may or may not be incorporated, depending upon on-site criteria or local ordinances and plumbing codes.

To accommodate these briefly enumerated variations attendant installation of plumbing in conjunction with drains, journeymen would have to transport a variety of prior art fixtures to the installation site. Necessarily, expenses associated with a supply of such equipment must be incurred and the journeyman must accommodate storage space in his toolbox or other transport related equipment. Furthermore, a substantial quantity of equipment must be maintained in stock on a continuing basis to meet any demand therefor, no matter how infrequent.

The present invention provides a journeyman with a choice of a plurality of optional modes of a single plumbing fixture to satisfy the many differing installation requirements attendant fluid flow from a drain. A P-trap is incorporated to prevent backflow of gases through the drain. Downstream of the P-trap, a vertically downardly directed aperture permits connection to a conduit forming a part of a sewage system. The outlet is closeable with a cap to permit use of a horizontally oriented outlet downstream of the P-trap in the event horizontal outflow is dictated by on-site parameters or functional requirements. A passageway extending from downstream of the P-trap upwardly permits interconnection with an upwardly extending vent pipe; alternatively, the outlet of the vent passageway may be sealed. Upstream of the P-trap, a vertically downwardly oriented outlet is located to permit direct downward fluid flow from the drain. This outlet is sealable with a cap or similar device to permit use of an outlet upstream of the P-trap and oriented horizontally to accommodate on-site structural impediments.

It is therefore a primary object of the present invention to provide a plumbing fixture connectable to a drain for providing a choice of a plurality of outlets and a vent to accommodate foreseeable installation requirements.

Another object of the present invention is to provide a plumbing fixture having a plurality of optionally selectable outlets formed integral with the fixture.

Yet another object of the present invention is to provide a plumbing fixture having a plurality of functionally distinct outlets and having an optionally usable vent.

Still another object of the present invention is to provide a one-piece plumbing fixture usable in a variety of configurations to accommodate all normal fluid flow requiremetns attendant a drain.

A further object of the present invention is to provide a plumbing fixture which is convertible to any of a plurality of fluid flow paths.

A yet further object of the present invention is to permit a journeyman to replace a plurality of plumbing fittings with a single integrated fixture and yet provide for selection of any of a plurality of fluid flow paths from a drain.

A still further object of the present invention is to reduce installation costs attendant channeling the fluid flow from a drain.

These and other objects of the present invention will become apparent to those skilled in the art as the description thereof proceeds.

The present invention may be described with greater specificity and clarity with reference to the following drawings, in which.

Figure 1:
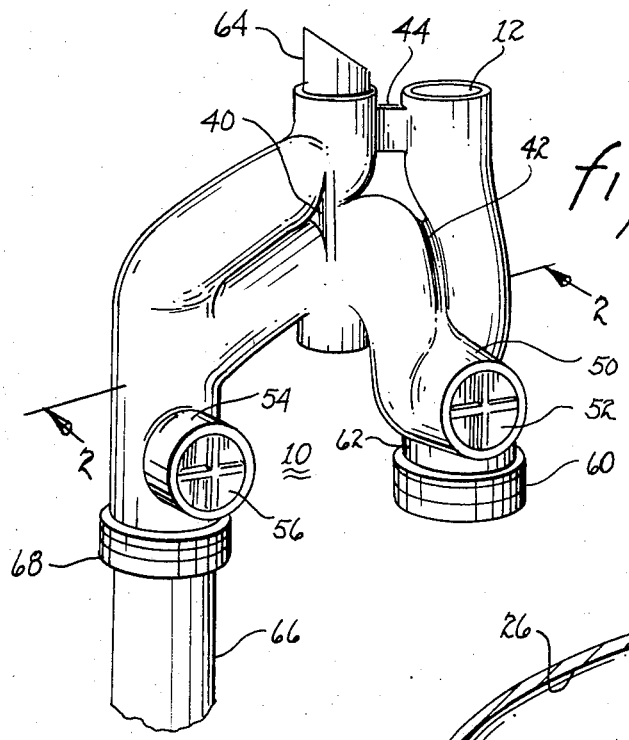
FIG. 1 is a perspective view of the integrated plumbing fixture.
Figure 2:
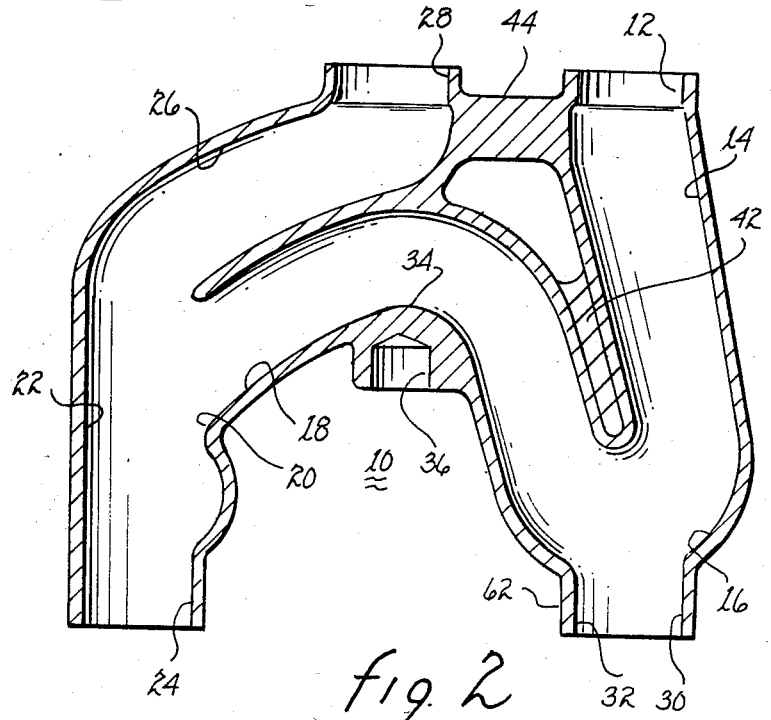
FIG. 2 is a cross-sectional view taken along lines 2—2, as shown in FIG. 1.

Referring to FIG. 1, there is shown an integrated plumbing fixture 10 having a downwardly oriented inlet 12. The inlet is connectable to a conventional drain or other source of fluid flow. It may include threads (not shown) or other elements for engaging a drain stub or the like. The inlet forms a part of a generally downwardly directed passageway 14, as illustrated in FIG. 2. Lower end 16 interconnects passageway 14 with an inverted U-shaped passageway 18. Outlet 20 of passageway 18 is in fluid communication with a generally vertically downwardly oriented passageway 22. The lower end of passageway 22 is defined by outlet 24. Upper end 26 of passageway 22 curves back upon passageway 18 and is terminated by an upwardly vertically oriented outlet 28. A downwardly vertically oriented passageway 30 extends from lower end 16 and is terminated by outlet 32.

With outlet 32 closed, the combination of passageway 14, lower end 16 and passageway 18 form what is known in the trade as a P-trap; that is, a quantity of fluid will always remain in lower end 16 to a height approximately equivalent to that of the lower most sidewall at the apex 34 of passageway 18. This body of fluid will preclude flow of gas therethrough and such gas would therefore not be exhausted through inlet 12. The P-trap also serves to dissuade certain insects and other life forms from migrating from outlet 24 or 28 of passageway 22 to inlet 12. Integrated plumbing fixture 10 may also includes a cylindrical cavity 36 for receiving a stanchion to display, mount or install the integrated plumbing fixture.

To add rigidity to the integrated plumbing fixture, a web 40 may be formed on each of opposed sides of the structure defining passageways 18 and 22. In the event the curved conduit defining passageways 18 and 14 are displaced from one another, as illustrated, a web 42 may be developed therebetween to add rigidity. To lend integrity to the upper end of the integrated plumbing fixture, a further web 44 may be employed to interconnect the structure defining inlet 12 and outlet 28.

Lower end 16 includes a laterally horizontally extending boss 50 in fluid communication with the lower end. The terminal end of boss 50 may include a knock out section 52 or other device to permit opening of the terminal end of the boss. Alternatively, boss 50 may be formed without any closure at the terminal end. A similar boss 54 extends from the lower part of the structure defining passageway 22. The terminal end of boss 54 may also have a knock out section 56 or other device for selectively opening the the terminal end of the boss. Alternatively, boss 54 may be formed without any closure at its terminal end.

From the above description it will become apparent to those skilled in the art that integrated plumbing fixture 10 is formable by conventional manufacturing techniques as a single unit. Hence, it is a plumbing fixture having a plurality of integrated elements the use of one of which is selectable to satisfy each of a number of optional fluid flow paths.

Referring particulary to FIG. 1, there is shown a typical installation of integrated plumbing fixture 10 for a sink. In such installation, a cap 60 is employed to circumscribingly engage conduit 62 defining outlet 32 whereby the outlet is sealed. A vent pipe 64 is secured to outlet 28 to vent any gases formed in or flowing into passageway 22. A conduit 66 is secured to outlet 24 of passageway 22 by a collar 68 or similar attachment mechanism. In the configuration described above, integrated plumbing fixture 10 is mounted to interconnect inlet 12 with the drain stub (not shown). In operation, fluid flow from the drain stub will flow into passageway 14, past lower end 16 through passageway 18 into passageway 22 and be discharged through conduit 66. Any gases conveyed by the fluid flow or through conduit 66 from a sewage system or the like, are precluded from exhausting through inlet 12 by the fluid captured in the P-trap. Any such gases will flow upwardly through passageway 22 and be exhausted into vent pipe 64 through outlet 28.

Figure 3:
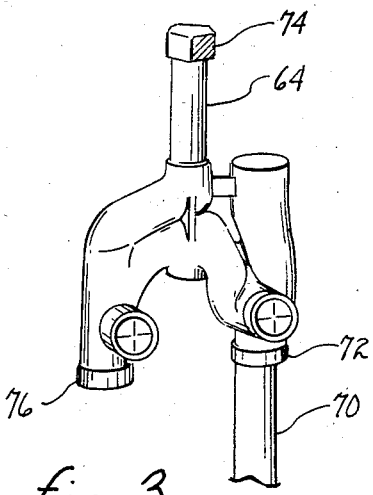
FIGS. 3, 4 and 5 illustrate various alternative fluid flow configurations available from the integrated plumbing fixture.

In certain installations, neither a P-trap nor a vent may be required adjacent the drain. For such installation, the configuration of integrated plumbing fixture 10 illustrated in FIG. 3 may be used. Conduit 70 for discharging the fluid flow is in fluid communication with outlet 32 and secured therto by collar 72 or other attachment means. Vent pipe 64 is sealed by a cap 74. A cap 76 is fitted to the structure defining outlet 24 to prevent any flow therethrough. The resulting fluid flow path through integrated plumbing fixture 10 is generally vertically downwardly from inlet 12, through passageway 14 and lower end 16 and through outlet 32 into conduit 70. Obviously, where on-site parameters dictate, vent pipe 64 may be uncapped rather than capped.

Figure 4:
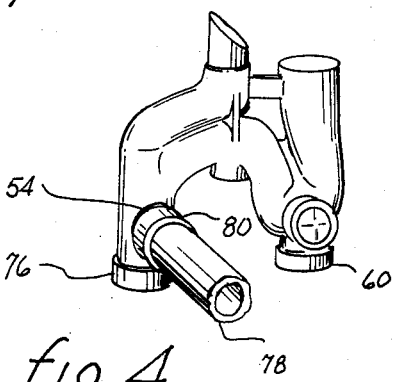

Certain space or peripheral plumbing requirements may preclude the use of a verticially extending exhaust conduit 66 as illustrated in FIG. 1. At such installation, flow from integrated plumbing fixture 10 is channeled through boss 54 into exhaust conduit 78, as illustrated in FIG. 4. To effect such installation, knock out section 56, if used, is removed to permit flow through the terminal end of boss 54. Exhaust conduit 78 may be attached to the boss by means of a collar 80 or equivalent attachment means. Outlets 24 and 32 are sealed by caps 76 and 60 or other stopper type devices to preclude flow through outlets 24 and 32. The flow through the configuration of integrated plumbing fixture 10 illustrated in FIG. 4 and described above is equivalent to that described with respect to the configuration shown in FIG. 1 except that the fluid is exhausted horizontally laterally through boss 54. Such direction of exhaust has no perceptible effect upon the venting capability of the integrated plumbing fixture nor upon the operation of the P-trap.

Figure 5:
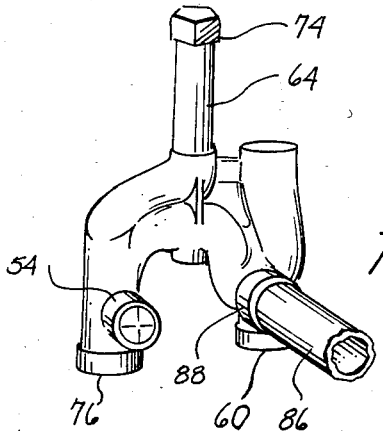

Often, the vertical space beneath a drain feeding into integrated plumbing fixture 10 may not permit further vertical discharge. At such location, the configuration of the integrated plumbing fixture as shown in FIG. 5 may be used. Herein, knock out section 52 attendant boss 50 is removed, if present. Exhaust conduit 86 is attached to boss 50 by a collar 88 or similar attachment means. Outlets 32 and 24 are capped by caps 76 and 90 to prevent flow therethrough. It is assumed that the terminal end of boss 54 is closed; if not, a cap or stopper type device is to be employed. The resulting flow from the drain attached to inlet 12 is through passageway 14 and into lower end 16. Therefrom, the flow is essentially horizontal through boss 50 and exhaust conduit 86. Vent pipe 64 may be capped by cap 74, as illustrated; alternatively, the cap may be removed in the event venting is to be available.

It is to be understood that the various outlets may be threaded to accept threaded caps or threaded conduits. Alternatively, the configuration of the structure defining the outlets may be such as to accept circumscribing collars or bands to secure caps or conduits thereto. Other attachment means are also contemplated.

From the above description of integrated plumbing fixture 10 and the various modes of installation and use, it will become apparent that a single fixture is provided which permits a variety of flow configurations and commensurate choices of mode of operation. Moreover, these variant fluid flow configurations are available without the necessity for constructing from a plurality of plumbing fittings equivalent flow paths. Thereby, installation costs are substantially reduced by the present invention. Additionally, the necessity for a journeyman to have available to him or carry with him a plurality of plumbing fittings to meet each and every one of the structural variants described above to obtain any particular operational mode is completely obviated. Substantial savings in equipment to be stocked and storgage space for such equipment are also made available by the present invention.

While the principles of the present invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. An integrated plumbing fixture for providing a plurality of selectable fluid flow paths from an inlet, said integrated plumbing fixture comprising in combination:

(a) a generally downwardly aligned passageway extending from said inlet and terminating at a generally downwardly oriented outlet, said passageway including a lower end;

(b) a generally inverted U-shaped passageway extending from said lower end and terminating at an outlet, said inverted U-shaped passageway in combination with said lower end and said passageway defining a P-trap;

(c) a vent extending upwardly from said inverted U-shaped passageway;

(d) a further passageway extending downwardly from said inverted U-shaped passageway and terminating in a further generally downwardly oriented outlet;

(e) a generally horizontally oriented outlet disposed at said lower end;

(f) a further generally horizontally oriented outlet disposed in said further passageway proximate said further generally downwardly oriented outlet; and (g) means for closing all but one of said generally downwardly oriented outlet, said further generally downwardly oriented outlet, said generally horizontally oriented outlet and said further generally horizontally oriented outlet to define the fluid flow path through said integrated plumbing fixture from said inlet.

2. The fixture as set forth in claim 1 wherein said vent extends upwardly adjacent a partial length of said inverted U-shaped passageway.

3. The fixture as set forth in claim 2 wherein said vent terminates at an upwardly oriented outlet.

4. The fixture as set forth in claim 1 wherein each of said generally horizontally oriented outlet and said further generally horizontally oriented outlet includes an hollow boss.

5. The fixture as set forth in claim 4 including closure means and wherein each of said hollow bosses is configured to receive said closure means to prevent fluid flow therethrough.

6. The fixture as set forth in claim 5 further including attachment means for securing said closure means.

7. The fixture as set forth in claim 1 including closure means and wherein each of said generally downwardly oriented outlet and said further generally downwardly oriented outlet is configured to receive said closure means to prevent fluid flow therethrough.

8. The fixture as set forth in claim 7 further including attachment means for securing said closure means.

9. The fixture as set forth in claim 1 wherein said vent includes means for inhibiting flow therethrough.

10. The fixture as set forth in claim 1 wherein each of said generally downwardly oriented outlet, said further generally downwardly oriented outlet, said generally horizontally oriented outlet and said further generally horizontally oriented outlet includes means for attaching a conduit to direct fluid flow thereinto.

11. The fixture as set forth in claim 10 wherein said attaching means comprises a collar.

12. The fixture as set forth in claim 11 wherein each of said generally horizontally oriented outlet and said further generally horizontally oriented outlet includes a knock out section prior to use.

13. A method for directing a flow of fluid through an integrated plumbing fixture from an inlet thereto, said method comprising the steps of:

(a) directing the fluid flow downwardly from the inlet to a lower end;

(b) discharging the fluid flow at the lower end through an optionally unclosed one of a downwardly oriented outlet and an horizontally oriented outlet located in proximity to the lower end;

(c) channeling fluid flow not exhausted from the lower end through an inverted U-shaped passageway;

(d) exhausting any fluid flow from the inverted U-shaped passageway through an optionally unclosed one of a further downwardly oriented outlet and a further horizontally oriented outlet located proximate the terminal end of the inverted U-shaped passageway; and (e) venting the inverted U-shaped passageway.

14. The method as set forth in claim 13 including the step of attaching a conduit to an open one of the downwardly oriented outlet, the further downwardly oriented outlet, the horizontally oriented outlet and the further horizontally oriented outlet.

15. The method as set forth in claim 13 including the step of terminating said step of venting upon discharge of fluid flow through the vertically oriented outlet or the horizontally oriented outlet.

* * * * *